US006164035A

United States Patent [19]

Roberts

[11] Patent Number: 6,164,035

[45] Date of Patent: Dec. 26, 2000

[54] REINFORCED FOAM BLOCK WALL

[76] Inventor: Scott J. Roberts, 20 W. Silver Spruce, Flagstaff, Ariz. 86001

[21] Appl. No.: 09/198,123

[22] Filed: Nov. 23, 1998

Related U.S. Application Data

[63] Continuation-in-part of application No. 08/730,940, Oct. 16, 1996, Pat. No. 5,839,249.

[51] Int. Cl.[7] ..... E04B 1/12

[52] U.S. Cl. ..... 52/563; 52/220.2; 52/309.7; 52/309.16; 52/439; 52/505; 52/605; 52/606; 52/565; 52/585.1; 52/586.1; 52/745.1; 52/742.12

[58] Field of Search ..... 52/564, 565, 396.08, 52/396.09, 586.1, 604–607, 309.9, 309.7, 309.12–309.14, 309.16, 309.17, 585.1, 562, 563 O, 503–505, 404.1, 439, 220.2, 745.05, 745.09, 742.12, 742.13, 742.16, 747.1, 745.1

[56] References Cited

U.S. PATENT DOCUMENTS

| | | | |
|---|---|---|---|
| 2,176,986 | 10/1939 | Briscoe . | |
| 3,166,873 | 1/1965 | Rosenfeld . | |
| 3,382,632 | 5/1968 | Grofcsik . | |
| 3,430,404 | 3/1969 | Muse . | |
| 3,552,076 | 1/1971 | Gregori . | |
| 3,566,568 | 3/1971 | Slobodian . | |
| 3,788,020 | 1/1974 | Gregori . | |
| 4,038,798 | 8/1977 | Sachs | 52/309.7 |
| 4,041,670 | 8/1977 | Kaplan . | |
| 4,048,778 | 9/1977 | Krings . | |
| 4,249,354 | 2/1981 | Wynn . | |
| 4,429,499 | 2/1984 | Kato . | |
| 4,475,326 | 10/1984 | Hanson . | |
| 4,726,567 | 2/1988 | Greenberg . | |
| 4,731,279 | 3/1988 | Isshiki . | |
| 4,787,189 | 11/1988 | Haug et al. | 52/415 |
| 4,835,928 | 6/1989 | Scott . | |
| 4,862,660 | 9/1989 | Raymond . | |
| 5,024,035 | 6/1991 | Hanson et al. . | |
| 5,265,389 | 11/1993 | Mazzone et al. . | |
| 5,279,089 | 1/1994 | Gulur . | |
| 5,305,529 | 4/1994 | Guardia . | |
| 5,371,990 | 12/1994 | SalahUddin . | |
| 5,426,904 | 6/1995 | Gilmore . | |
| 5,457,926 | 10/1995 | Jensen . | |
| 5,566,517 | 10/1996 | Ishii et al. . | |
| 5,921,046 | 7/1999 | Hammond, Jr. | 52/564 |
| 6,000,186 | 12/1999 | Fielding et al. | 52/564 |
| 6,050,749 | 4/2000 | Khamis | 405/286 |

FOREIGN PATENT DOCUMENTS

| | | |
|---|---|---|
| 826584 | 11/1969 | Canada . |

*Primary Examiner*—Carl D. Friedman
*Assistant Examiner*—Yvonne M. Horton
*Attorney, Agent, or Firm*—Fletcher, Yoder & Van Someren

[57] ABSTRACT

A foam wall assembly including vertical passageways that guide wall support elements. The wall assembly includes a lower end and an upper support element that are affixed to the wall support elements. The foam wall includes inner and outer thermal barriers that thermally isolate the wall support elements.

20 Claims, 7 Drawing Sheets

REINFORCED FOAM BLOCK WALL

RELATED APPLICATIONS

This application is a continuation-in-part of Ser. No. 08/730,940 filed on Oct. 16, 1996, now U.S. Pat. No. 5,839,249.

FIELD OF THE INVENTION

This invention is related to foam block walls, and more particularly, to block walls including vertically extending block alignment elements.

BACKGROUND OF THE INVENTION

The prior art discloses a variety of wall designs fabricated from a plurality of stackable insulating foam blocks. For example, U.S. Pat. No. 5,024,035 (Hanson) discloses an interlocking, structural foam block having vertical channels. Hanson fails to disclose any technique for accurately aligning the blocks prior to grouting the block cells with cement.

U.S. Pat. No. 5,457,926 (Jensen) discloses interlocking foam building blocks, but Jensen's design fails to overcome the problem of attaching wall-mounted devices to the wall system or a fail-safe technique for vertically and horizontally aligning the discrete block elements into a straight wall.

U.S. Pat. No. 3,788,020 (Gregori) discloses a self-supporting concrete form made from foamed polymeric material left in place after the concrete has been poured. A thin, heat conductive transverse member connects the inner and outer wall forms, but greatly reduces the insulating capability of the wall because that transverse member also functions as a thermal bridge. The Gregori wall design requires an inner frame structure to mount interior walls, electrical conduit and junction boxes, and cabinets. Gregori fails to disclose an effective technique for aligning adjacent wall elements.

U.S. Pat. No. 4,862,660 (Raymond) discloses a foam wall formed around a plastic load bearing member. While the Raymond wall design provides for placement of wall-mounted devices, the load bearing columns function as a thermal bridge significantly reducing the wall insulating efficiency.

U.S. Pat. No. 4,731,729 (Isshiki) discloses a foam block wall reinforced by a bar inserted through the bores of selected blocks. While that bar may reinforce the strength of the wall, Isshiki does not teach the use of a vertical reinforcement member to align a wall, nor the use of a vertical reinforcement member for mounting structures to the wall.

SUMMARY OF THE INVENTION

It is therefore a primary object of the present invention to provide a foam block or heating insulating wall including a vertically extending block alignment element capable of laterally aligning each of a plurality of vertically stacked blocks relative to one another.

Another object of the present invention is to provide a foam block wall which can be accurately aligned by a block alignment element prior to grouting adjacent cells with concrete.

Yet another object of the present invention is to provide a foam block wall with a coupling surface forming a part of each block alignment element for receiving and retaining elongated fastening devices penetrating through the block sidewall.

Yet another object of the present invention is to provide a foam wall assembly having a structural support element.

Additionally, the foam wall assembly includes a lower guide system to facilitate placement of the foam wall along a foundation prior to placement of the structural support element.

Briefly stated, and in accord with one embodiment of the invention, a foam wall assembly includes a foam wall having an upper end, a lower end, opposing parallel-oriented exterior side surfaces and at least one passageway extending vertically between the upper and lower ends. The at least one passageway defines reduced thickness sidewalls or thermal barriers between the exterior side surfaces and the internal passageway. A guide system is mounted along a foundation and configured to engage the lower end. Additionally, a support element extends through the at least one passageway and includes a first end and a second end. The at least one passageway is oriented to guide the support element to a proper attachment location on the guide system. A fastener secures the support element opt the guide system.

BRIEF DESCRIPTION OF THE DRAWINGS

The invention will hereafter be described with reference to the accompanying drawings, wherein like reference numerals denote like elements, and.

DETAILED DESCRIPTION OF THE PREFERRED EMBODIMENTS

In order to better illustrate the advantages of the invention and its contributions to the art, a preferred hardware embodiment of the invention will now be described in some detail.

Figure 1:
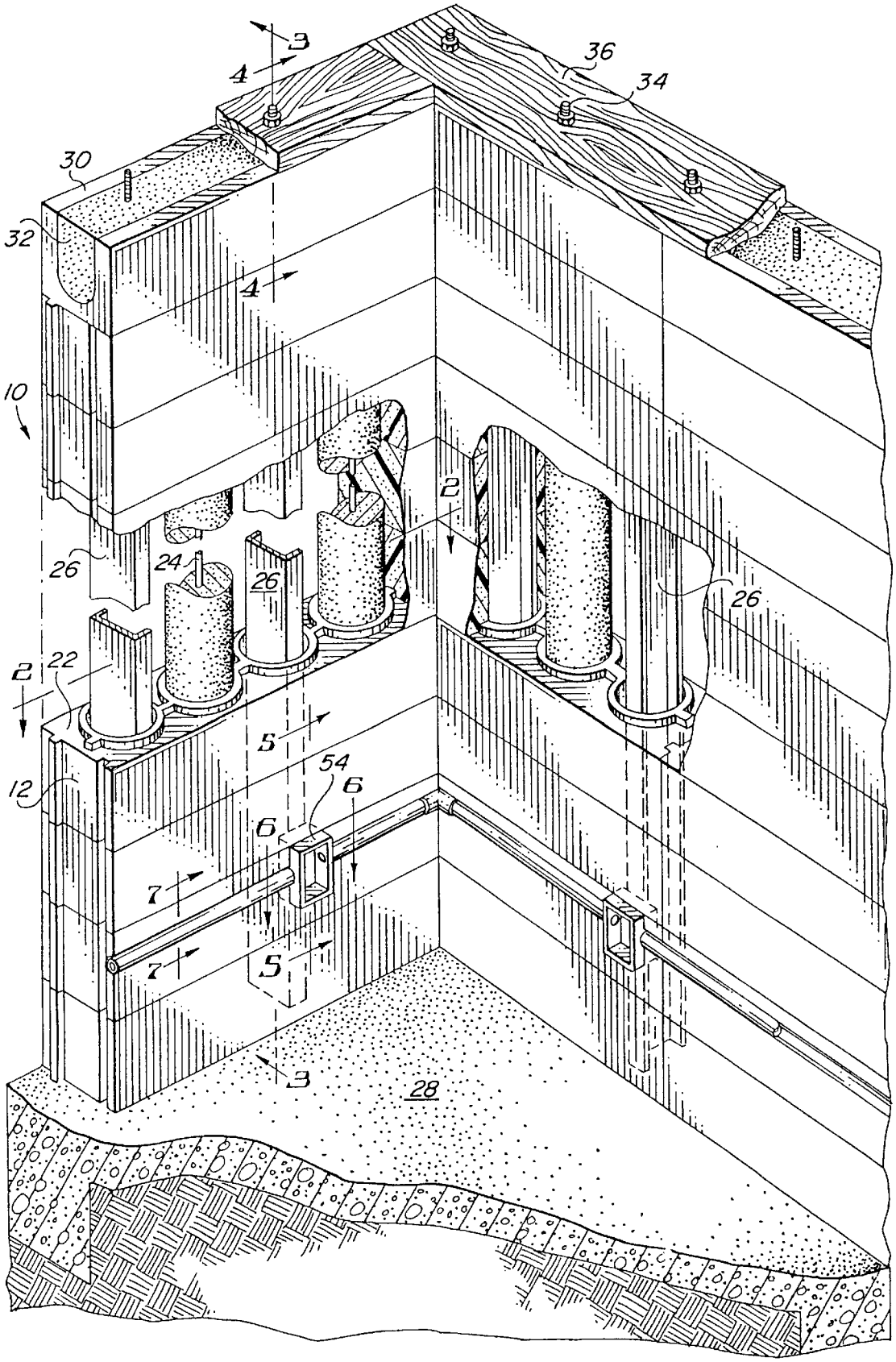
FIG. 1 represents a partially cutaway perspective view of one embodiment of the foam block wall of the present invention.
Figure 3:
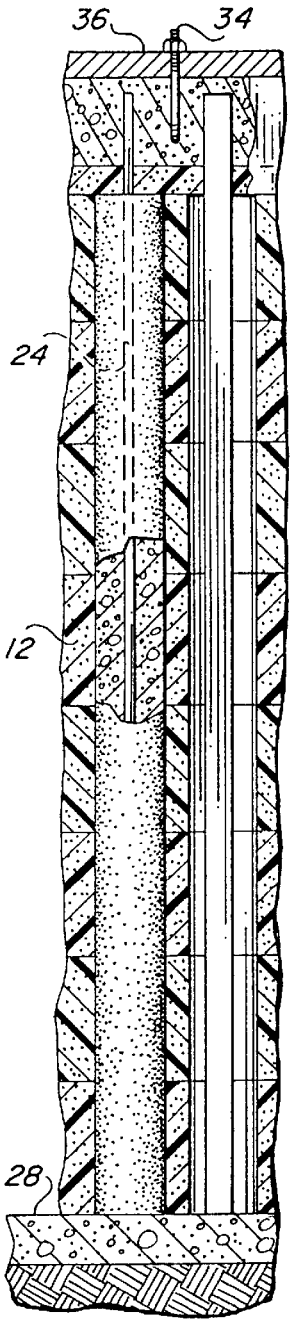
FIG. 3 represents a partially cutaway elevational view of the block wall illustrated in FIG. 1, taken along section lines 3—3.
Figure 2:
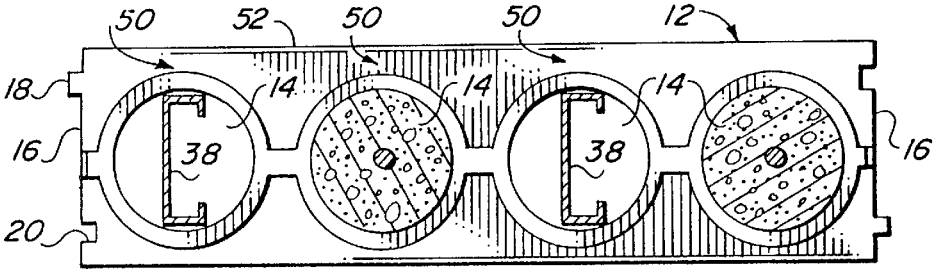
FIG. 2 represents a sectional view of the block wall illustrated in FIG. 1, taken along section lines 2—2.

FIGS. 1, 2 and 3 illustrate a heat insulating block wall 10 constructed from a plurality of conventional prefabricated urethane or polystyrene foam blocks 12. As illustrated in FIGS. 1 and 2, each foam block 12 includes a series of four laterally spaced apart, vertically oriented cylindrical passageways 14. Each block includes an end surface 16 including a tongue and groove system for interfacing a locking together the ends of the adjacent blocks. As illustrated in FIG. 2, each tongue and groove end section includes a tongue element 18 and a groove element 20.

As illustrated in FIG. 1, a similar tongue and groove block interlocking system is utilized on the block upper surface 22 with a complementary pattern on the lower surface of adjacent blocks to interlock adjacent blocks together in the vertical direction.

The block wall of the present invention may be assembled above a conventional foundation and footer arrangement 28 as illustrated in FIGS. 1 and 3 with reinforcing bars or rebar 24 extending vertically upward through every other vertically oriented passageway as illustrated in FIG. 3.

During construction of an insulating block wall according to the present invention, a series of foam blocks 12 are stacked up to form an unsecured wall having an appropriate length and height. Before grouting the rebar containing cells with concrete, it is critical to precisely align the plurality of blocks both vertically as well as laterally. This block alignment function is accomplished by inserting a series of block alignment elements 26 through the open passageways of the highest blocks until the base of each block alignment element contacts the supporting concrete slab 28. During this insertion operation, block alignments 26 should be jiggled or rotated to assist in implementing the alignment function as they are inserted through the uppermost block toward slab 28. After block alignment elements 26 have been inserted into all of the open passageways 14, the individual blocks 12 forming wall 10 will be precisely aligned, causing the entire wall system comprising a plurality of previously unsecured blocks to become a relatively rigid, stand-alone integrated wall. This partially completed, but substantially rigidified wall is capable of resisting high level wind loads on a temporary basis until the remaining passageways 14 have been grouted with concrete.

Figure 4:
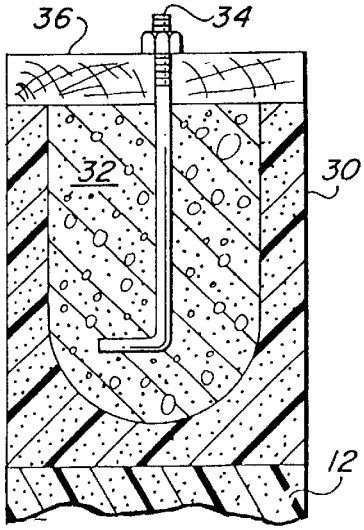
FIG. 4 represents a partially cutaway elevational view of the block wall illustrated in FIG. 1, taken along sections 4—4.
Figure 5:
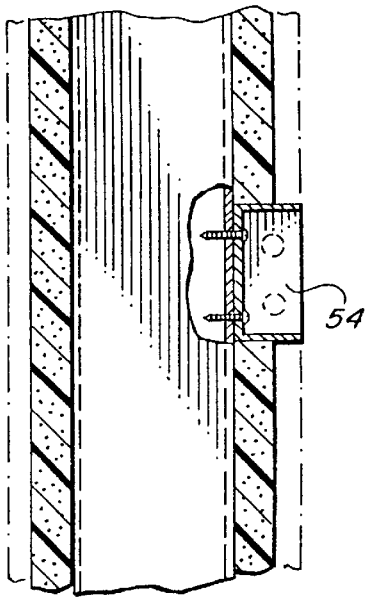
FIG. 5 represents a partially cutaway elevational view of the block wall illustrated in FIG. 1, taken along section lines 5—5.

FIGS. 1, 3 and 4 illustrate how a second urethane foam block configuration 30 is provided to function as a wall cap. Each block 30 includes a horizontally oriented, U-shaped channel. Although not illustrated in the drawings, blocks 30 include tongue and groove coupling elements on the end surfaces and on the lower surfaces similar to those described in connection with blocks 12. The lateral spacing between the tongue and groove structure is preferably sufficient to allow those coupling elements to remain intact when the interior portion of block 30 is cut out and removed to form bond beam 30 as shown in FIG. 4. As illustrated in FIG. 4, a conventional J-bolt 34 and wood plank 36 mounting system facilitates coupling the wall system of the present invention to other building structures.

Figure 6:
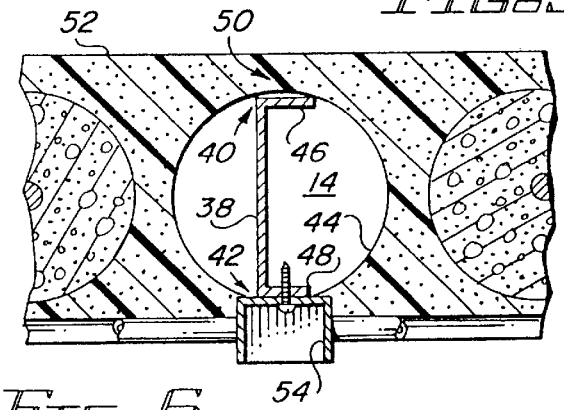
FIG. 6 represents a partially cutaway elevational view of the block wall illustrated in FIG. 1, taken along section line 6—6.

As illustrated in FIGS. 1, 2 and 6, a preferred embodiment of block alignment 26 includes a conventional metal C-channel 38 of the type typically used in modern residential and commercial construction as a replacement for wooden wall studs. The block passageways 14 are dimensionally configured to precisely accommodate such C-channel structures 38.

Each block alignment element 26 in the form of C-channel 38 includes a first edge alignment surface 40 and a second edge alignment surface 42 which relatively tightly engage the inner cylindrical surface 44 of passageway 14. C-channel alignment element 38 further includes a first coupling surface 46 and a second coupling surface 48. The ends or outer corners of these two coupling surfaces also contact and engage inner surface 44 of passageway 14. As a direct result of the engagement between the four edges or corners of C-channel 38 with the interior surface 44 of passageway 14 along the vertical dimension of C-channel 38, the semi-rigid galvanized or coated metal structure of C-channel 38 gradually relocates and aligns a series of vertically stacked blocks as it is inserted downward through passageway 14. Wooden, plastic or any other material capable of being rigid for alignment purposes and capable of holding fasteners such as screws may be used as a substitute for a metal alignment element 38.

The insertion and jiggling of C-channel 38 during its downward travel within passageway 14 allows the spring-like structure of C-channel 38 to gradually displace unaligned blocks 12 into a precisely aligned configuration. The cooperative and additive effect of the alignment forces generated by a plurality of inserted C-channel alignment elements exerts relatively high level block alignment forces and not only facilitates the initial alignment of a plurality of blocks, but also generates and continuously maintains relatively high order block alignment forces preventing blocks 12 from subsequently becoming misaligned by wind generated or equivalent intermittent forces.

Depending on structural requirements, most applications of the present invention will involve concrete grouting of a selected number of spaced apart passageways 14 or cells such as illustrated in FIG. 1 which depicts the grouting of every other cell with concrete. During the grouting operation, the alignment forces exerted by alignment elements 38 maintains the blocks in the desired aligned position and prevents unintended contacts with the block wall structure from displacing individual blocks out of the aligned position. Accordingly, when the concrete cures, a fully aligned, high strength wall remains.

Figure 7:
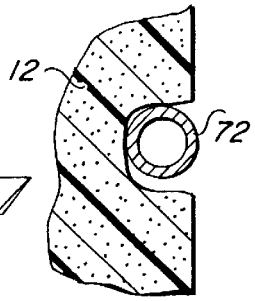
FIG. 7 represents a partially cutaway elevational view of the block wall illustrated in FIG. 1, taken along section lines 7—7.
Figure 8:
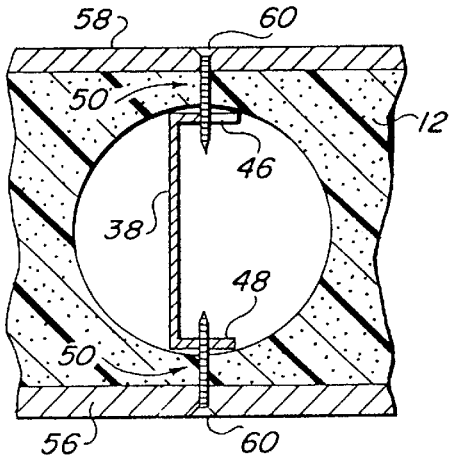
FIG. 8 represents a partially cutaway elevational view of a C-shaped block alignment element including fastening devices penetrating through both the interior and exterior sidewalls of the block for securing wall-mounted devices to the outside and inside of the block wall.

In addition to assisting with the block alignment function, coupling surfaces 46 and 48 also provide a highly advantageous method for attaching or securing wall-mounting devices such as drywall, siding, plumbing, electrical conduit and junction boxes directly to the outer surface of the block wall 10. As illustrated in FIGS. 2 and 7, a reduced thickness sidewall region 50 is created between interior surface 44 of passageway 14 and exterior surface 52 of individual blocks 12. As most clearly illustrated in FIGS. 1 and 6, an electrical junction box 54 can be fitted within a countersunk recess cut directly into the side of a section of block wall 10. An elongated fastening device such as a screw can readily be passed through the vertically oriented, rear sidewall of junction box 54 such that it penetrates directly through sidewall 50 and engages coupling surface 48 to secure junction box 54 directly to C-channel alignment element 38. As illustrated in FIG. 8, screws or equivalent elongated fastening devices can be drilled directly through a sheet of drywall 56 to directly mount the drywall surface to the exterior surface of blocks 12. Similarly, as illustrated in FIG. 8, siding 58 as well as many other materials or structures can be directly mounted to the opposite side of blocks 12 by fastening devices such as screws 60.

The tension force generated by fastening device 60 between drywall sheet 56 and the relatively large surface area of coupling surface 48 compresses the portion of block 12 lying within reduced thickness sidewall area 50 and provides substantial holding forces for securing various materials to C-channel 38 which serves as an internalized mounting or coupling structure.

The unique coupling and mounting configuration of the present invention allows various other types of wall-mounted devices such as cabinets, plumbing structures, shutter and numerous other building structures and accessories to readily be directly attached to and detached from the exterior surface wall structure 10 of the present invention.

Figures 11, 12, 13, 14, 15, 16:
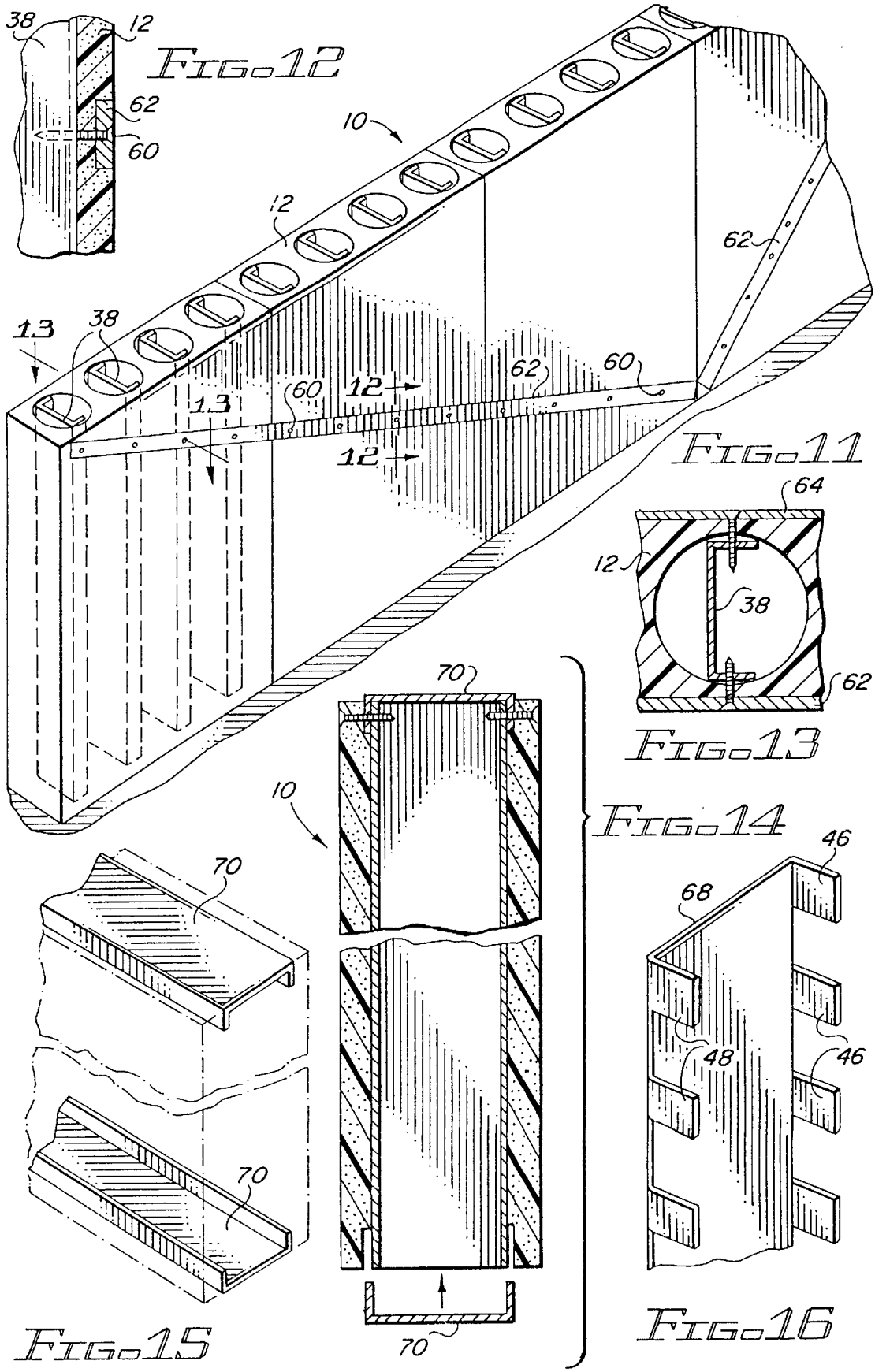
FIG. 11 illustrates a foam block wall fabricated from a series of foam blocks, including a series of load bearing capable block alignment elements together with a diagonal block wall brace illustrating the use of foam blocks without the use of concrete.
FIG. 12 represents a partially cutaway elevational view of the block wall illustrated in FIG. 11, taken along section lines 12—12.
FIG. 13 represents a partially cutaway elevational view of the block wall illustrated in FIG. 11, taken along section lines 13—13.
FIG. 14 represents a partially cutaway cross-sectional view of a block wall including wall-mounted devices on the exterior and interior surface and caps on the top and bottom.
FIG. 15 represents a partially cutaway perspective view of the wall illustrated in FIG. 14.
FIG. 16 represents a partially cutaway perspective view of a block alignment element including spaced apart coupling surface elements.
Figure 17:
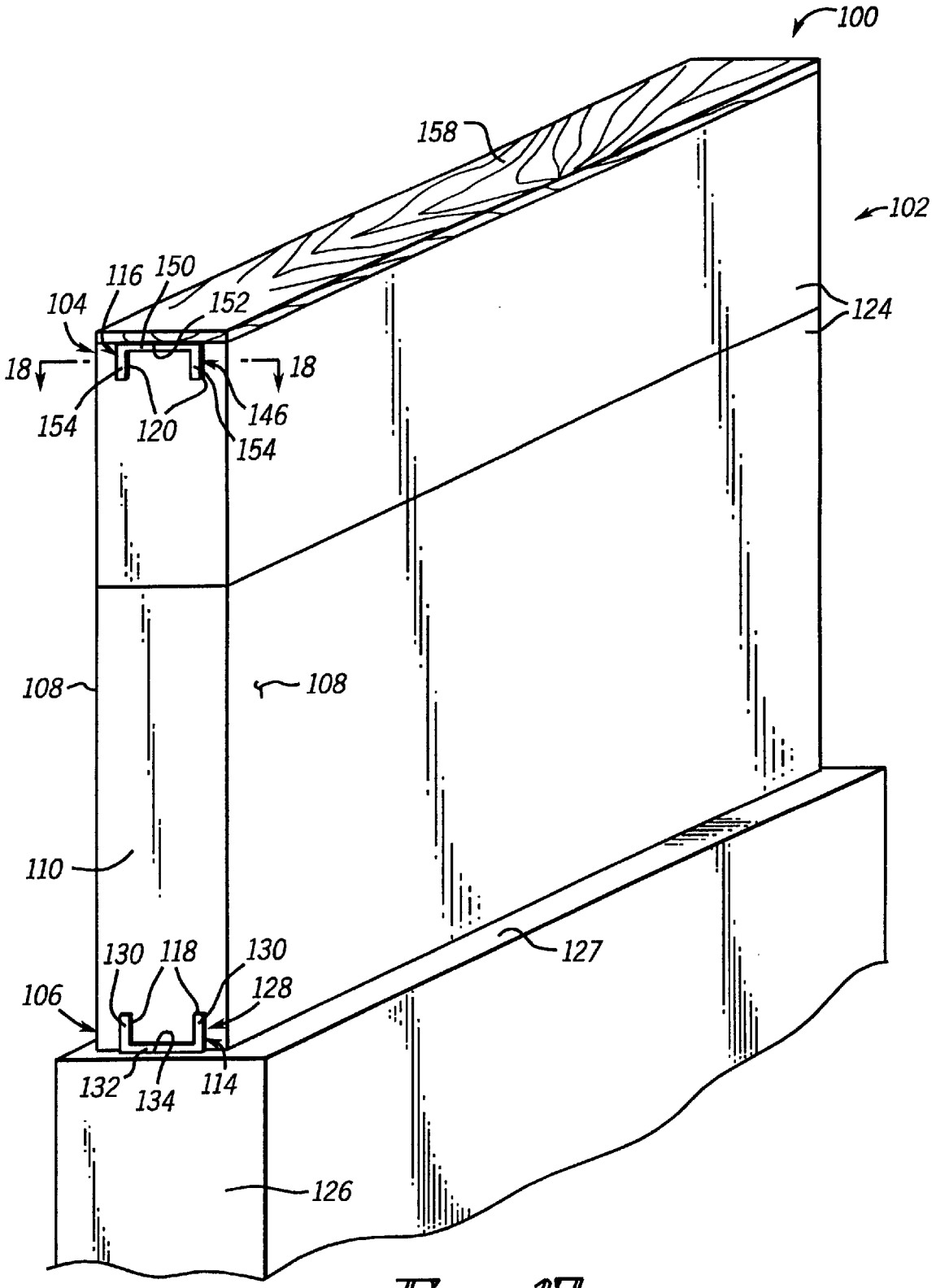
FIG. 17 is a perspective view of an alternate foam wall assembly, according to a preferred embodiment of the present invention.

As illustrated in FIG. 11, a diagonal brace 62 can be configured to extend at an angle across a substantial length of blocks 12 to provide a significant enhancement in wall rigidity, either with or without concrete reinforcement by additional concrete grouting. As illustrated in FIG. 11, concrete grouting and rebar have been eliminated and instead a C-channel block alignment element 38 has been inserted into each vertically oriented passageway 14 of the block wall system. FIG. 13 illustrates how brace 62 may be attached to one side of block wall 10 while another wall-mounted device 64 is attached to the opposite exterior surface of blocks 12. FIG. 12 illustrates that brace 62 may be embedded or recessed in the exterior surface 52 of blocks 12 to maintain a flush wall surface which does not interfere with the addition of yet another form of wall- mounted device.

Figure 9:
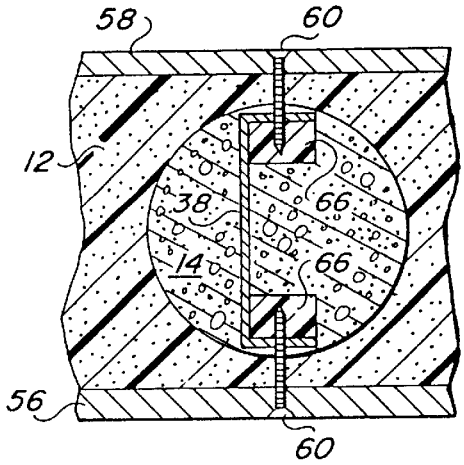
FIG. 9 represents a partially cutaway elevational view of a modified C-shaped block alignment element including fastening strips for securing wall-mounted devices to the exterior and interior sidewalls of the block where the previously open block passageway has been filled with cured concrete.

FIG. 9 illustrates yet another modification of the present invention where foam, wood or equivalent strips 66 have been secured to coupling surfaces 46 and 48 of C-channel 38 to displace concrete. In this embodiment of the invention, C-channel 38 replaces rebar and accommodates concrete grouting. Strips 66 allow fastening devices 60 to penetrate through coupling surfaces 46 and 48 and to further penetrate into strips 66, a function which could not be performed were strip 66 omitted and that volume replaced by solid concrete. The modified structure of block alignment element 38 permits fastening devices 60 to be inserted, removed and replaced at will without interference from the solidly grouted concrete interior within passageway 14.

FIG. 16 illustrates a different configuration of block alignment element 68 which includes coupling surfaces 46 and 48 which are disposed at spaced apart intervals along an appropriate length or length segment of alignment element 68.

Figure 10A:
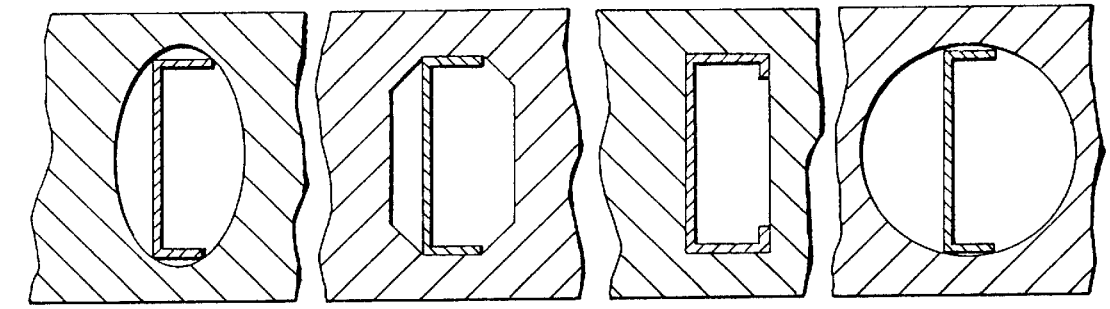
FIG. 10A illustrates a series of four partially cutaway elevational views depicting various block passageway configurations and various block alignment element configurations.
Figure 10B:
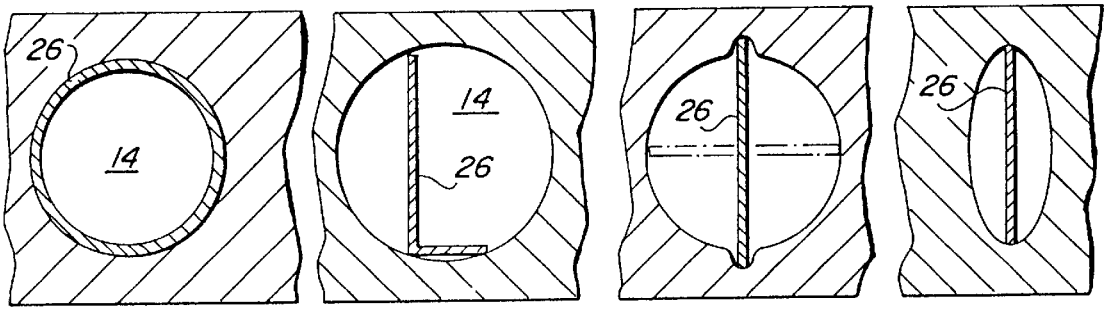
FIG. 10B illustrates a series of four partially cutaway elevational views depicting various block passageway configurations and various block alignment element configurations.
Figure 10C:
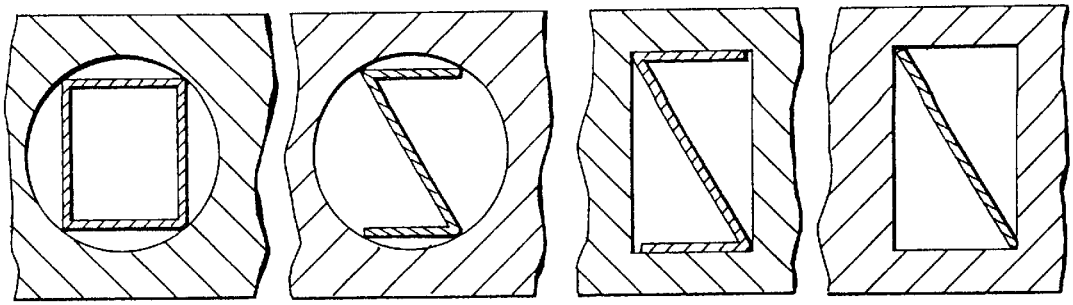
FIG. 10C illustrates a series of four partially cutaway elevational views depicting various block passageway configurations and various block alignment element configurations.

FIGS. 10A, 10B and 10C illustrate a wide variety of alternative configurations for block alignment element 26 of the present invention to demonstrate the structural characteristics of that element required to perform its inventive function and the fact that the structural configuration of that element can assume a wide variety of embodiments and configurations while still performing the necessary alignment and coupling functions. Those same drawing figures also illustrate that the configuration of passageway 14 does not represent a meaningful limitation on the scope of the present invention. Instead, the sixteen alternative embodiments of the present invention illustrated in FIG. 10 demonstrate that the essence of the present invention resides in the contact between two or more spaced apart surfaces on either a continuous or intermittent basis with the vertically oriented passageways extending between the upper and lower surfaces of a single block 12.

As illustrated in FIG. 10B, block alignment elements 26 can take the form of a rectangular sheet having edges which engage the inner surface of passageway 44 at only two spaced apart locations. The L-shaped block alignment element 26 illustrated in FIG. 10B contacts the interior surface of passageway 14 at three angularly spaced apart intervals while the round or tubular block alignment element 26 illustrated in FIG. 10B contacts the interior surface of passageway 14 around essentially its entire circumference. An oval embodiment of the circular block alignment element 26 could also be provided as a fully functional alternative design.

FIGS. 14 and 15 illustrate the use of U-shaped cap sheets 70 configured to fit into receiving grooves located at the upper and lower extremities of block wall 10 to seal off passageways 14 and to provide further reinforcement of block wall 10.

FIGS. 1 and 7 illustrate that the recess can be cut into the exterior surface 52 of block wall 10 to receive electrical conduit 72. The flush mounting provided for electrical conduit 72 still allows a drywall sheet to be flush mounted against exterior surface 52 of block wall 10.

The unique structural configuration of the present invention provides a high heat insulation level by avoiding the use of thermal bridge elements extending between the exterior and interior surfaces of the block wall assembly. As illustrated in FIGS. 8 and 13, only essentially insignificant thermal bridge is created when both exterior and interior wall surfaces are directly connected to the wall by a series of spaced apart fastening devices such as screws 60. Only the small area screw head is exposed to ambient temperature and transmits only a minuscule amount of thermal energy through the wall system of the present invention. While block alignment element 38 may be fabricated from a thermally conductive metal material, it is insulated from both the outside and inside surfaces of blocks 12 by insulating sidewall areas 50.

Referring generally to FIGS. 17–20, another embodiment in the form of an insulated wall assembly 100 is illustrated. The unique wall assembly 100 is designed for use in structures, such as residential homes and other buildings. The unique design provides for economical construction of walls that have great strength and provide a high degree of insulation, i.e. have a high R value.

In the embodiment illustrated, insulated wall assembly 100 includes a foam wall 102 having a top end 104, a bottom end 106 and a pair of generally parallel wall surfaces 108. Preferably, wall surfaces 108 are generally planar and extend between top end 104 and bottom end 106. Additionally, foam wall 102 includes a pair of sides 110 that may complete a side of the structure being built or serve as an end against which another foam wall may be positioned.

Foam wall 102 also includes a plurality of openings 112 that extend therethrough from top end 104 to bottom end 106. Openings 112 are thus oriented generally upright or vertical when insulated wall assembly 100 is positioned in place as part of a wall in a desired structure. Foam wall 102 preferably also includes an orientation feature 114 disposed along its bottom end 106 and an upper orientation feature 116 disposed along its top end 104.

Figure 18:
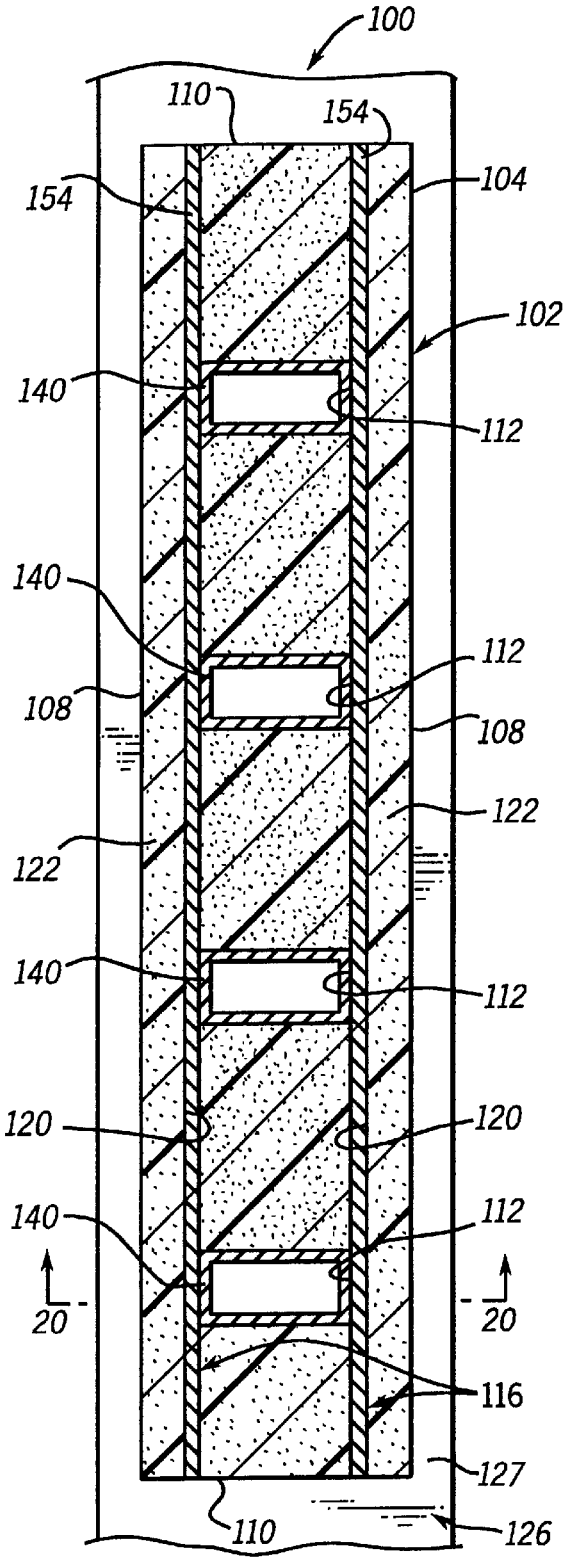
FIG. 18 is a cross-sectional view of the wall assembly taken generally along line 18—18 of FIG. 17.

In the illustrated embodiment, orientation feature 114 comprises a pair of recesses or grooves 118 that extend upwardly into foam wall 102 and run generally parallel to one another adjacent the ends of openings 112. Similarly, upper orientation feature 116 preferably includes a pair of recesses or grooves 120 that extend downwardly into foam wall 102 and run generally parallel to one another along the top end 104. Grooves 120 also may be disposed to run proximate the ends of openings 112 as described with respect to grooves 118, and as best illustrated in FIG. 18.

Effectively, grooves 118 and grooves 120 demarcate a pair of thermal barrier sections 122 that lie between openings 112 and wall surfaces 108. Thermal barrier sections 122 preferably extend along the entire wall surfaces 108 to ensure that any structural members extending through openings 112 are completely thermally isolated between the wall surfaces 108, and typically between the interior and exterior of the dwelling.

Depending on the size of the overall structure being built as well as material handling and transportation considerations, foam wall 102 may be constructed as a unitary piece or as a plurality of foam wall blocks or sections 124. Exemplary foam wall sections 124 may be stacked above one another vertically. Additionally, the foam wall sections 124 may have varying heights, e.g. 2 feet or 4 feet heights, to accommodate the construction of a variety of structural walls having various standard heights. If desired, engagement features can be incorporated into the wall section 124 to facilitate stacking or joining, as disclosed in the embodiments described above.

Foam wall 102 may be made from a variety of materials that can be formed as a foam. For example, sections 124 could be made from polyurethane. Preferably, however, foam wall 102 is made from a polystyrene foam, because such foam is relatively inexpensive to manufacture and can be made in large sheets or sections.

Foam wall 102 is designed to be mounted along a foundation, such as an elongate foundation 126. Elongate foundation 126 typically has a generally planar top surface 127 and comprises a concrete material. For example, the foundation may be formed from poured concrete or concrete block.

Insulated wall assembly 100 includes a guide system 128 that facilitates proper positioning of foam wall 102 along foundation 126. Specifically, orientation feature 114 is designed for engagement with guide system 128 to properly align foam wall 102 along foundation 126. Preferably, guide system 128 is affixed to elongate foundation 126.

In the illustrated embodiment, guide system 128 includes a pair of tabs 130 that extend upwardly from foundation 126. Tabs 130 are aligned generally parallel and spaced for receipt by grooves 118 of orientation feature 114. Alternatively, bottom end 106 of foam wall 102 may be pressed onto guide system 128 to form appropriate recesses, e.g., grooves 118.

Figure 19:
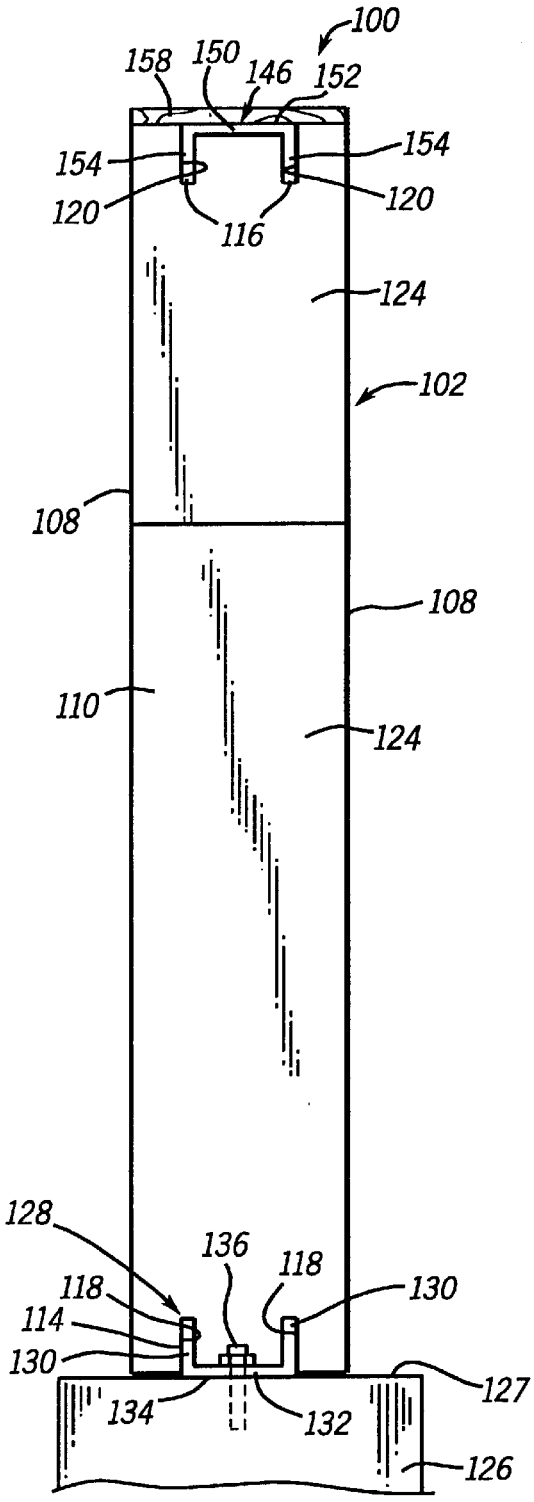
FIG. 19 is an end view of the wall assembly illustrated in FIG. 17.
Figure 20:
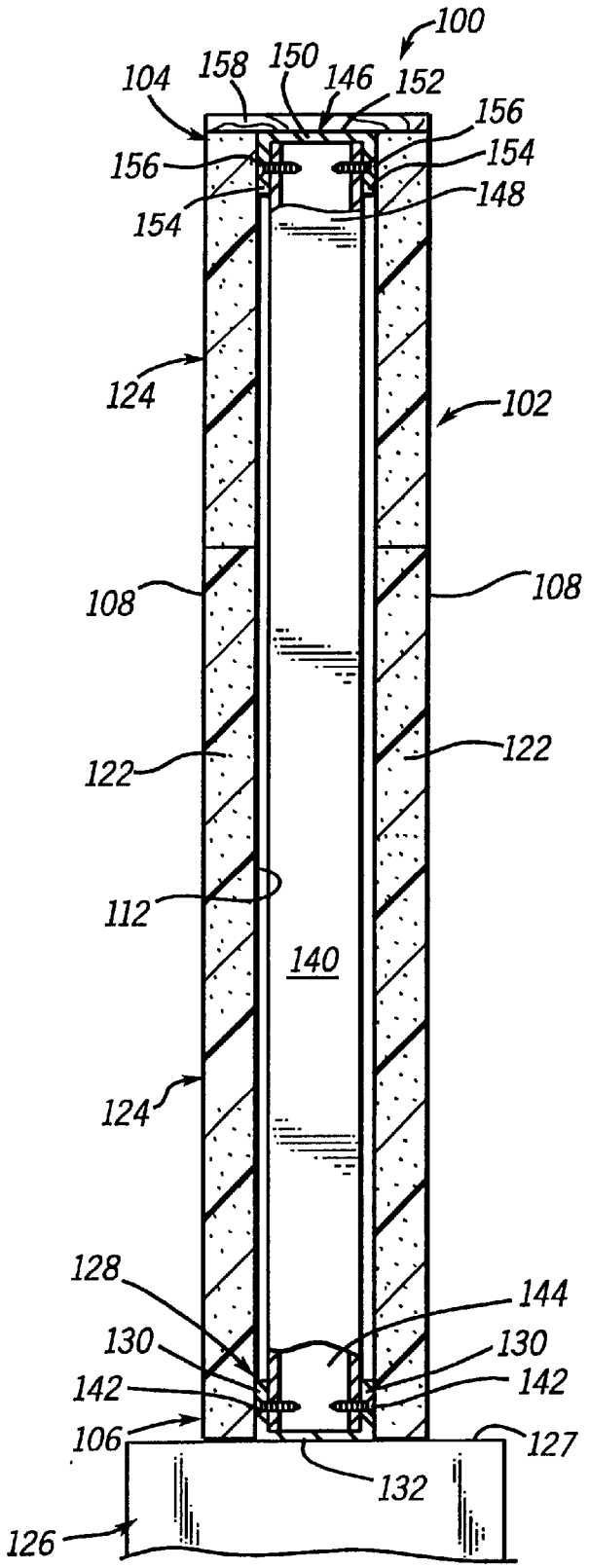
FIG. 20 is a cross-sectional view taken generally along line 20—20 of FIG. 18.

One method of forming tabs 130 comprises mounting a section of C-channel 132 via elongate foundation 126, as illustrated in FIGS. 19 and 20. C-channel 132 is disposed with its back panel 134 along foundation 126 such that the legs of the C-channel comprise tabs 130. C-channel 132 may be affixed to foundation 126 by a variety of fasteners 136, such as anchor bolts.

A plurality of support studs 140 are disposed through the plurality of openings 112. Each support stud 140 is firmly secured to foundation 126, by, for instance, affixing each support stud 140 to guide system 128. For example, an exemplary support stud is a hollow, rectangular, steel support stud sized to fit between tabs 130. Appropriate fasteners 142, such as self-tapping metal screws, can then be used to secure each stud 140 to guide system 128, at a lower stud end 144. The self-tapping screws may be disposed in generally transverse, threaded engagement through tabs 130 and into the appropriate steel support stud 140.

The C-channel 132 and the plurality of support studs 140 can be made from a strong structural support material, such as steel, to provide insulated wall assembly 100 with great strength. It should be noted that, if necessary, a small portion of each thermal barrier section 122 can be removed proximate C-channel 132 at each support lower end 144 to accommodate the threading of fasteners 142 through tabs 130 and into a corresponding support stud 140. The removal of small portions of the thermal barrier to accommodate fasteners, e.g. screws, has minimal effect on the insulation value of wall assembly 100.

Preferably, a support structure 146 extends horizontally along a plurality of top ends 148 of support studs 140. Support structure 146 is disposed at the top end 104 of foam wall 102.

In the illustrated embodiment, support structure 146 comprises a metal C-channel 150 having a back panel 152 and a pair of legs or tabs 154 disposed generally perpendicular to back panel 152. Tabs 154 extend slightly downwardly along each support stud 140 and are received in upper orientation feature 116. Specifically, grooves 120 are sized and oriented to receive tabs 154. As described with respect to guide system 128, support structure 146 may be secured to the plurality of support studs 140 by appropriate fasteners 156, such as self-tapping metal screws that extend transversely through tabs 154 and into each of the respective support studs 140. A top plate 158, made from plywood or an equivalent material, can be mounted to support structure 146 to span the thickness of foam wall 102, as illustrated in FIG. 19.

To assemble insulated wall assembly 100, the foundation 126 is first laid, as is commonly done for a wide variety of structures, such as residential dwellings and commercial buildings. When the foundation 126 is laid or during construction of foundation 126, appropriate fasteners 136, e.g. anchor bolts, are disposed along a span that will receive an insulated wall assembly 100. The guide system 128 is then affixed to foundation 126 by fasteners 136. The foam wall 102 is then oriented along guide system 128 and pressed into place such that guide system 128 is received by orientation feature 114. In the preferred embodiment, tabs 130 of C-channel 132 are received in grooves 118.

Once foam wall 102 is mounted to guide system 128, the plurality of openings 112 provide guide slots for guiding appropriate support studs 140 into their appropriate locations along foundation 126 and guide system 128. For example, if the structure requires support studs spaced at 16 inches, the openings 112 are formed with centers 16 inches apart. Thus, there is no need to perform the added step of measuring distances along foundation 126 for the mounting of support studs 140. Preferably, openings 112 are formed with a cross-sectional shape, e.g. rectangular, that corresponds with the general cross-sectional shape of support studs 140. When thus formed, support studs 140 may be inserted into openings 112 proximate top end 104. Each opening 112 guides its corresponding support stud to a perfect, predetermined location between tabs 130.

Once in position, each support stud 140 may be securely affixed to foundation 126 and guide system 128 by threading appropriate fasteners 142 through tabs 130 and into the bottom end 144 of the support stud 140. After securing the plurality of support studs 140 to guide system 128, the upper support structure 146 then may be inserted into upper orientation feature 116 and fastened to the plurality of support studs 140 via appropriate fasteners 156. Additionally, top plate 158 may be mounted to support structure 146 by a variety of appropriate mechanisms, such as bolts, screws or adhesives.

At this stage, the insulated wall assembly 100 has been completed. The combination of guide system 128, support studs 140 and upper support structure 146 provide an extremely strong wall. This is particularly true when these components are made from a construction material, such as steel. However, even if the structural materials are made from a highly conductive material, such as steel, the outer thermal barrier sections 122 of foam wall 102 serve to totally isolate these thermally conductive construction materials between the outer wall surfaces 108 of insulated wall assembly 100. In other words, any potential thermal or heat transfer paths are broken. Thus, insulated wall assembly 100 is an extremely efficient structure to build, and yet it provides great strength as well as extremely desirable thermal characteristics.

While the present invention has been described in connection with a particular conventional urethane or styrene foam block design as best illustrated in FIG. 1 utilizing tongue and groove block interlocking structures and four vertical passageways 14, the present invention can accommodate many different forms of block designs as is readily apparent from the sixteen alternative block designs illustrated in FIG. 10. Rebar and concrete grouting may be utilized or omitted to satisfy the structural strength requirements of specific wall applications. The foam wall assemblies may be made in a variety of configurations and from a variety of materials depending on the specific application. It will be readily apparent to those skilled in the art that the disclosed insulating foam wall design may be modified in numerous other ways and may assume many embodiments other than the preferred forms specifically set out and described above. Accordingly, is intended by the appended claims to cover all such modifications of the invention which fall within the true spirit and scope of the invention.

What is claimed is:

1. A wall assembly for use in a structure, comprising:

an elongate foundation structure having an upper, generally horizontal surface;

a pair of rigid tabs disposed along the elongate foundation and extending upwardly from the generally horizontal surface;

a foam wall having a pair of grooves disposed to receive the pair of rigid tabs therein, the foam wall including a plurality of holes therethrough; and a plurality of studs extending through the plurality of holes, wherein each stud includes a lower end attached to at least one of the pair of rigid tabs.

2. The wall assembly as recited in claim 1, wherein the foam wall includes a plurality of foam sections.

3. The wall assembly as recited in claim 1, wherein the elongate foundation structure comprises concrete.

4. The wall assembly as recited in claim 1, wherein the pair of rigid tabs comprise a pair of legs of a C-channel.

5. The wall assembly as recited in claim 4, wherein the C-channel is attached to the elongate foundation structure by a plurality of fasteners.

6. The wall assembly as recited in claim 1, further comprising a support member connected to a plurality of upper ends of the plurality of studs.

7. The wall assembly as recited in claim 6, wherein the support member includes a pair of generally parallel support tabs, and the foam wall includes a second pair of grooves for receiving the pair of parallel support tabs.

8. The wall assembly as recited in claim 7, wherein the plurality of upper ends are attached to at least one of the pair of generally parallel support tabs.

9. The wall assembly as recited in claim 8, wherein the pair of generally parallel support tabs comprise a pair of legs of a C-channel.

10. A method for constructing a wall, comprising:

preparing a foam wall panel with a plurality of openings, therethrough;

mounting a guide system along a foundation;

aligning the foam wall panel with the guide system;

mounting the foam wall panel along the guide system such that the plurality of openings is generally vertical; and utilizing the plurality of openings to guide a plurality of support studs through the foam wall and to the guide system.

11. The method as recited in claim 10, further comprising attaching the plurality of support studs to the guide system.

12. The method as recited in claim 11, further comprising connecting a generally horizontal support member to the plurality of support studs on an opposite side of the foam wall panel from the guide system.

13. The method as recited in claim 10, wherein preparing includes forming the foam wall panel of a polystyrene material.

14. The method as recited in claim 10, wherein mounting includes fastening a C-channel to the foundation.

15. The method as recited in claim 14, further comprising forming a pair of grooves along the foam wall panel such that the plurality of openings is disposed between the grooves of the pair of grooves; and inserting the C-channel into the grooves.

16. The method as recited in claim 15, further comprising attaching the plurality of support studs to the C-channel by a plurality of screws.

17. The method as recited in claim 10, wherein preparing includes forming the foam wall panel from a plurality of foam wall sections.

18. An insulated wall assembly for use in construction, comprising:

a foam wall having a bottom end, a top end and a pair of generally parallel wall surfaces extending between the bottom end and the top end; the foam wall including a plurality of openings extending therethrough from the bottom end to the top end;

a lower horizontal support disposed along the bottom end, the lower horizontal support having an engagement feature that engages the bottom end;

an upper horizontal support; and a plurality of generally vertical support studs extending through the plurality of openings, each generally vertical support stud being connected to the engagement feature and the upper horizontal support; wherein the foam wall includes a pair of thermal barrier sections disposed between each generally parallel wall surface and the plurality of generally vertical support studs.

19. The insulated wall assembly as recited in claim 18, wherein the foam wall comprises polystyrene.

20. The insulated wall assembly as recited in claim 18, wherein the plurality of generally vertical support studs comprise support studs having a generally rectangular cross-section.

* * * * *